US007471166B2

(12) United States Patent
Wei et al.

(10) Patent No.: US 7,471,166 B2
(45) Date of Patent: Dec. 30, 2008

(54) BALANCED-TO-UNBALANCED TRANSFORMER EMBEDDED WITH FILTER

(75) Inventors: Chang-Lin Wei, Miaoli County (TW); Chang-Sheng Chen, Taipei (TW); Syun Yu, Chiayi (TW); Ying-Jiunn Lai, Pingtung County (TW); Uei-Ming Jow, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 153 days.

(21) Appl. No.: 11/633,545

(22) Filed: Dec. 5, 2006

(65) Prior Publication Data

US 2007/0132526 A1 Jun. 14, 2007

(30) Foreign Application Priority Data

Dec. 8, 2005 (TW) ..... 94143412 A
Nov. 17, 2006 (TW) ..... 95142511 A

(51) Int. Cl.
*H01P 5/10* (2006.01)
*H01P 1/20* (2006.01)
*H01P 1/203* (2006.01)

(52) U.S. Cl. ..... 333/26; 333/204

(58) Field of Classification Search ..... 333/25, 333/26, 204
See application file for complete search history.

(56) References Cited

U.S. PATENT DOCUMENTS 6,791,431 B2 9/2004 De Flaviis
6,803,835 B2 10/2004 Frank
6,850,127 B2 * 2/2005 Sakakura et al. ..... 333/25
6,954,116 B2 * 10/2005 Nosaka ..... 333/26
7,116,185 B2 * 10/2006 Ohi et al. ..... 333/26
7,176,776 B1 * 2/2007 Tantwai et al. ..... 336/200

OTHER PUBLICATIONS

Electronics Letters vol. 38, Issue 11, pp. 519-520, May 23, 2002.

* cited by examiner

*Primary Examiner*—Dean O Takaoka
(74) *Attorney, Agent, or Firm*—Birch, Stewart, Kolasch & Birch, LLP

(57) ABSTRACT

A balanced-to-unbalanced transformer embedded with a filter, the balanced-to-unbalanced transformer being disposed in a multi-layered substrate and comprising vertically coupled transmission lines designed in different layers in the multi-layer substrate to increase transmission performances. A capacitor and a transmission line are connected to a single-ended I/O port of the balanced-to-unbalanced transformer such that a filter is embedded in the balanced-to-unbalanced transformer.

12 Claims, 6 Drawing Sheets

BALANCED-TO-UNBALANCED TRANSFORMER EMBEDDED WITH FILTER

BACKGROUND OF THE INVENTION

1. Field of the Invention

The present invention generally relates to a balanced-to-unbalanced transformer embedded with a filter and, more particularly, to a balanced-to-unbalanced transformer embedded with a filter using a multi-layered substrate. In the balanced-to-unbalanced transformer, there are vertically coupled transmission lines designed in different layers in the multi-layer substrate to increase transmission performances. A capacitor and a transmission line are connected to a single-ended I/O port of the balanced-to-unbalanced transformer such that impedance matching is achieved and a band-pass filter is embedded in the balanced-to-unbalanced transformer.

2. Description of the Prior Art

In recent years, chip circuits with a balanced output have attracted tremendous attention in wireless communication applications such as power amplifiers, radio frequency (RF) transceivers because the differential output circuits help to resist the high-frequency noise. The purpose of a balanced-to-unbalanced transformer (balun) is to transform an unbalanced signal in the wireless transceivers to a pair of balanced differential signals that have the same amplitude and are 180 degrees out-phased. Therefore, the common-mode noise is prevented. It can also be realized to transform a pair of balanced differential signals to an unbalanced signal. In addition to the afore-mentioned balanced-to-unbalanced transformer, the filter is another key element to filter out the undesired noise signal so as to improve transmission quality.

The balanced-to-unbalanced transformer and the filter can be implemented using discrete surface mounted device (SMD) with capacitors and inductors. However, in the circuit using SMD elements, the characteristics of the real elements may be different from that of the designed elements. On the other hand, open circuits may occur due to improper soldering for the discrete passive elements. Accordingly, the state-of-the-art balanced-to-unbalanced transformer and filter are no longer designed using discrete passive elements.

In the U.S. Pat. No. 6,803,835 entitled "Integrated Filter Balun", a conventional balanced-to-unbalanced transformer integrated with a filter is disclosed using ladder-type and lattice-type filters with distributed ¼ wavelength and ¾ wavelength transmission lines. Even though U.S. Pat. No. 6,803,835 provides a balanced-to-unbalanced transformer integrated with a filter with a small area equal to that of a conventional balanced-to-unbalanced transformer, it requires more elements to implement a filter.

In addition, in the U.S. Pat. No. 6,791,431 entitled "Compact Balun with Rejection Filter for 802.11A and 802.11B Simultaneous Operation", a 180 degree hybrid circuit with a band reject filter is provides to achieve a balanced-to-unbalanced transformer. However, the balanced-to-unbalanced transformer using the hybrid circuit requires a 50-ohm resistor and ⅔ wavelength transmission lines.

In "LTCC-MLC Chip-type Balun Realised by LC Resonance Method" published in Electronics Letters, May 23, 2002, vertically coupled transmission lines are utilized in the balanced-to-unbalanced transformer. However, the circuit structure does not include the balanced-to-unbalanced transformer with a filter.

Therefore, vertically coupled transmission lines and a multi-layered substrate are never applied in a balanced-to-unbalanced transformer embedded with a filter. Therefore, the conventional balanced-to-unbalanced transformer embedded with a filter suffers from a large size.

Therefore, there exists a need in providing a balanced-to-unbalanced transformer embedded with a filter using a multi-layered substrate. In the balanced-to-unbalanced transformer, there are vertically coupled transmission lines designed in different layers in the multi-layer substrate to increase transmission performances. A capacitor and a transmission line are connected to a single-ended I/O port of the balanced-to-unbalanced transformer such that impedance matching is achieved and a band-pass filter is embedded in the balanced-to-unbalanced transformer.

SUMMARY OF THE INVENTION

It is a primary object of the present invention to provide a balanced-to-unbalanced transformer embedded with a filter using a multi-layered substrate.

It is a secondary object of the present invention to provide a balanced-to-unbalanced transformer embedded with a filter using a multi-layered substrate with vertically coupled transmission lines so as to reduce the circuit area and manufacture the filter in a printed-circuit board (PCB) substrate, a ceramic substrate or an IC substrate for a wireless balanced-to-unbalanced transformer.

BRIEF DESCRIPTION OF THE DRAWINGS

The objects, spirits and advantages of the preferred embodiments of the present invention will be readily understood by the accompanying drawings and detailed descriptions, wherein.

DETAILED DESCRIPTION OF THE PREFERRED EMBODIMENT

The present invention providing a balanced-to-unbalanced transformer embedded with a filter can be exemplified by the preferred embodiments as described hereinafter.

Figure 1:
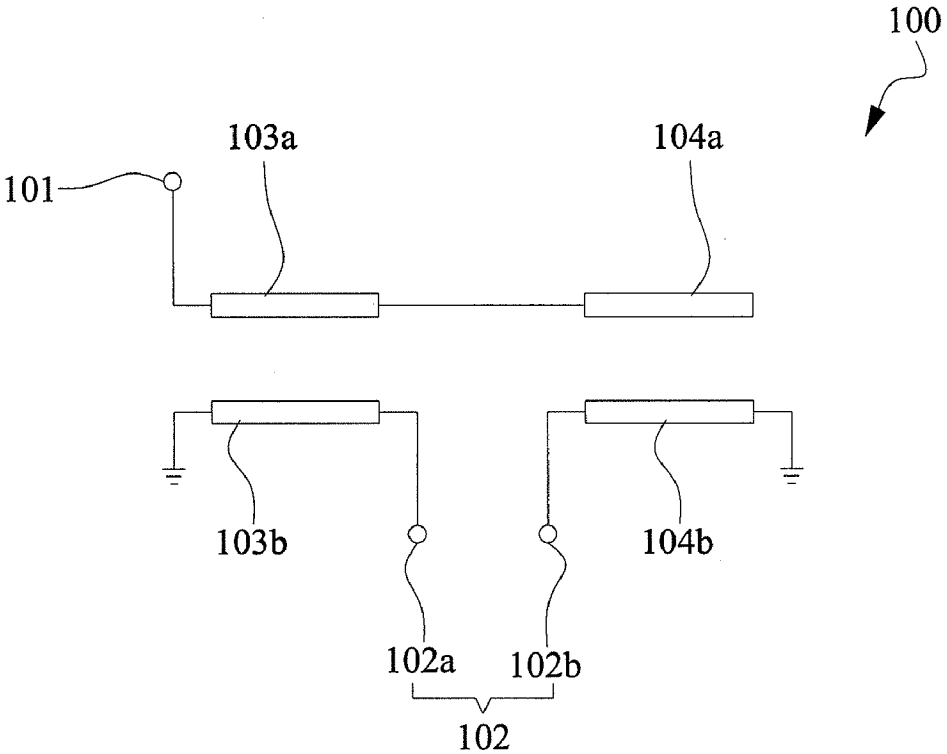
FIG.1 (Prior Art)
FIG. 1 is a circuit diagram of a conventional planar balanced-to-unbalanced transformer.

Please refer to FIG. 1, which is a circuit diagram of a conventional planar Marchand balanced-to-unbalanced transformer. Terminal 101 is a single-ended I/O port, and terminal 102 is a differential transmission I/O port formed of terminal 102*a* and terminal 102*b*. The balanced-to-unbalanced transformer 100 is planar and uses approximately ¼ wavelength transmission lines 103*a*, 103*b*, 104*a* and 104*b* such that edge coupling occurs between the transmission lines 103*a* and 103*b* and also between the transmission lines 103*a* and 103*b* so as to achieve balanced-to-unbalanced transformation.

Figure 2:
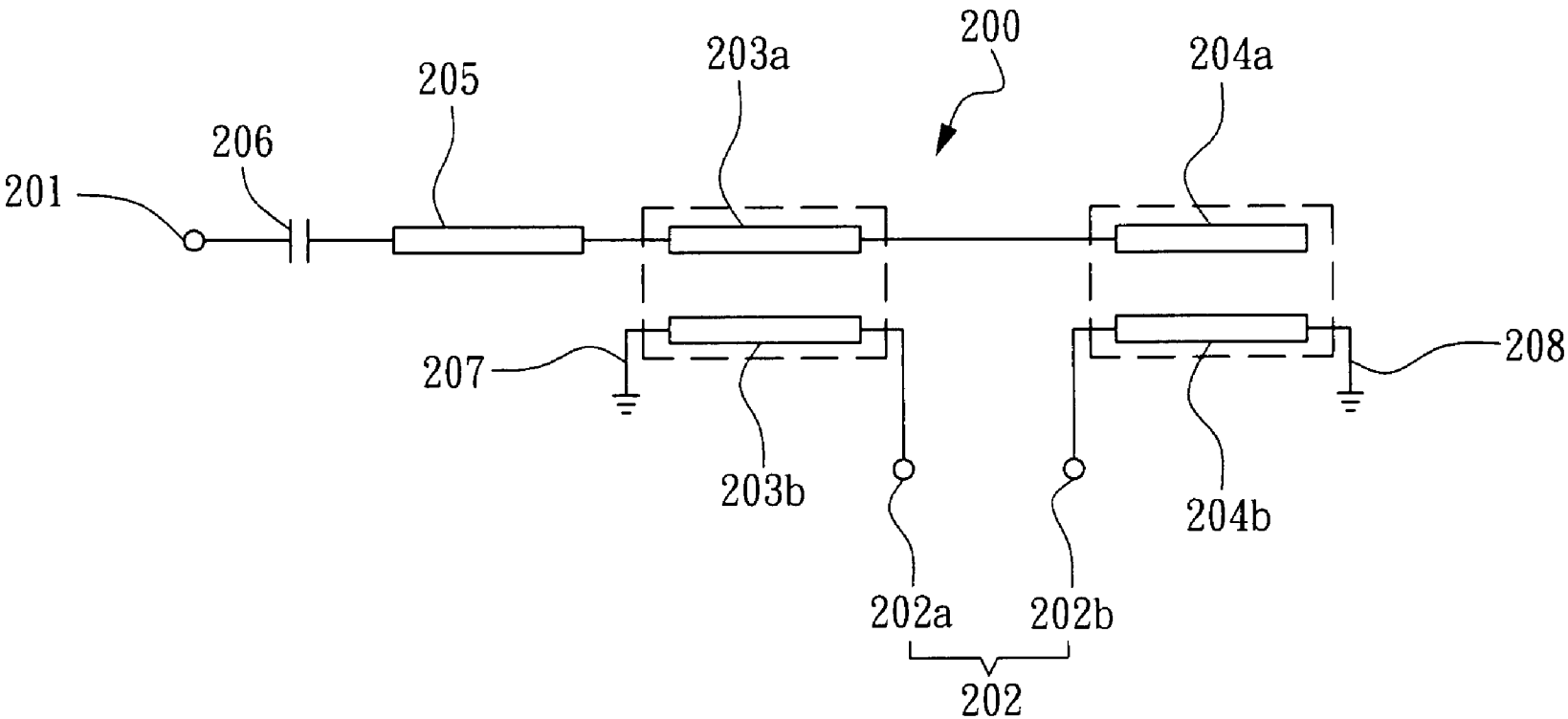
FIG. 2 is a circuit diagram of a balanced-to-unbalanced transformer embedded with a filter according to the present invention.

FIG. 2 is a circuit diagram of a balanced-to-unbalanced transformer embedded with a filter according to the present invention. Terminal 201 is a single-ended I/O port, and terminal 202 is a differential transmission I/O port formed of terminal 202*a* and terminal 202*b*. The balanced-to-unbalanced transformer 200 uses a multi-layered substrate, in which there are disposed broad side coupled transmission lines 203*a* and 204*a* on a top layer and broad side coupled transmission lines 203*b* and 204*b* on a bottom layer such that large-area vertical coupling occurs between the transmission lines 203*a* and 203*b* and also between the transmission lines 203*a* and 203*b* so as to achieve balanced-to-unbalanced transformation. In the present invention, the transmission performance is enhanced and the length of transmission lines is reduced. On the other hand, a serial capacitor 206 and a transmission line 205 are disposed between the single-ended I/O port 201 and the broad side coupled transmission lines 203*a* such that impedance matching is achieved and a band-pass filter is formed in the multi-layered substrate. Therefore, in the present invention, the band-pass filter is embedded in the balanced-to-unbalanced transformer 200.

Figure 3:
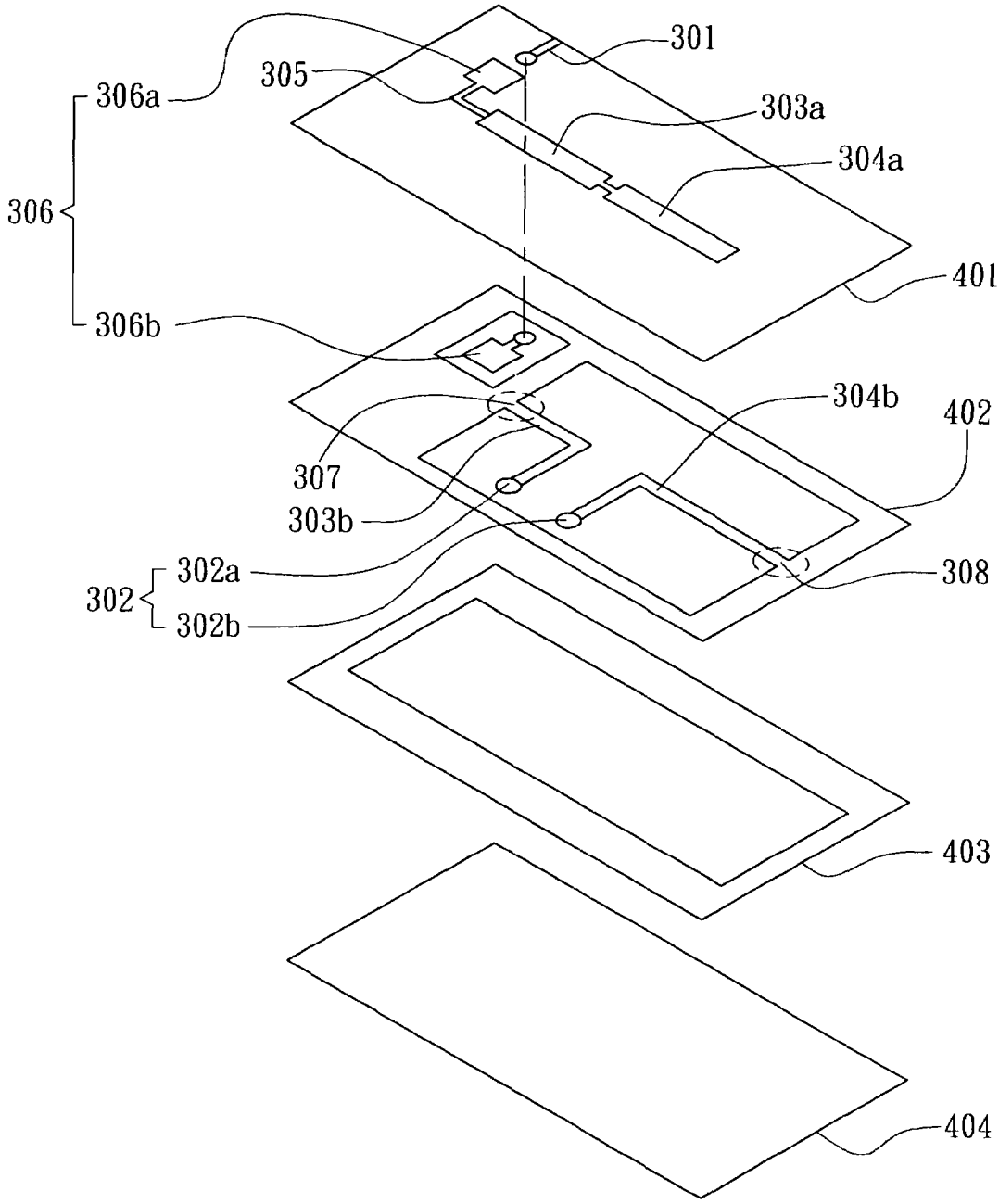
FIG. 3 is a layout diagram of a balanced-to-unbalanced transformer embedded with a filter according to the present invention.

FIG. 3 is a layout diagram of a balanced-to-unbalanced transformer embedded with a filter according to the present invention. The balanced-to-unbalanced transformer uses a multi-layered substrate comprising at least four layers. The present invention is characterized in that the conventional planar circuit configuration is replaced by a vertical configuration and also that the ¼ wavelength edge coupled transmission lines are replaced by broad side coupled transmission lines. More particularly, a single-ended I/O port 301, a differential transmission I/O port 302 formed of terminal 302*a* and terminal 302*b*, a first transmission line 303*a* coupled to a second transmission line 304*a*, and a fifth transmission line 305 coupled to a first electrode 306*a* of a serial capacitor 306 are disposed on the first metal layer 401. On the second metal layer 402, a third transmission line 303*b*, a fourth transmission line 304*b*, a second electrode 306*b* of the serial capacitor 306, a first grounding node 307 and a second grounding node 308 are provided. Both the third and the fourth metal layers are grounded.

Figure 4:
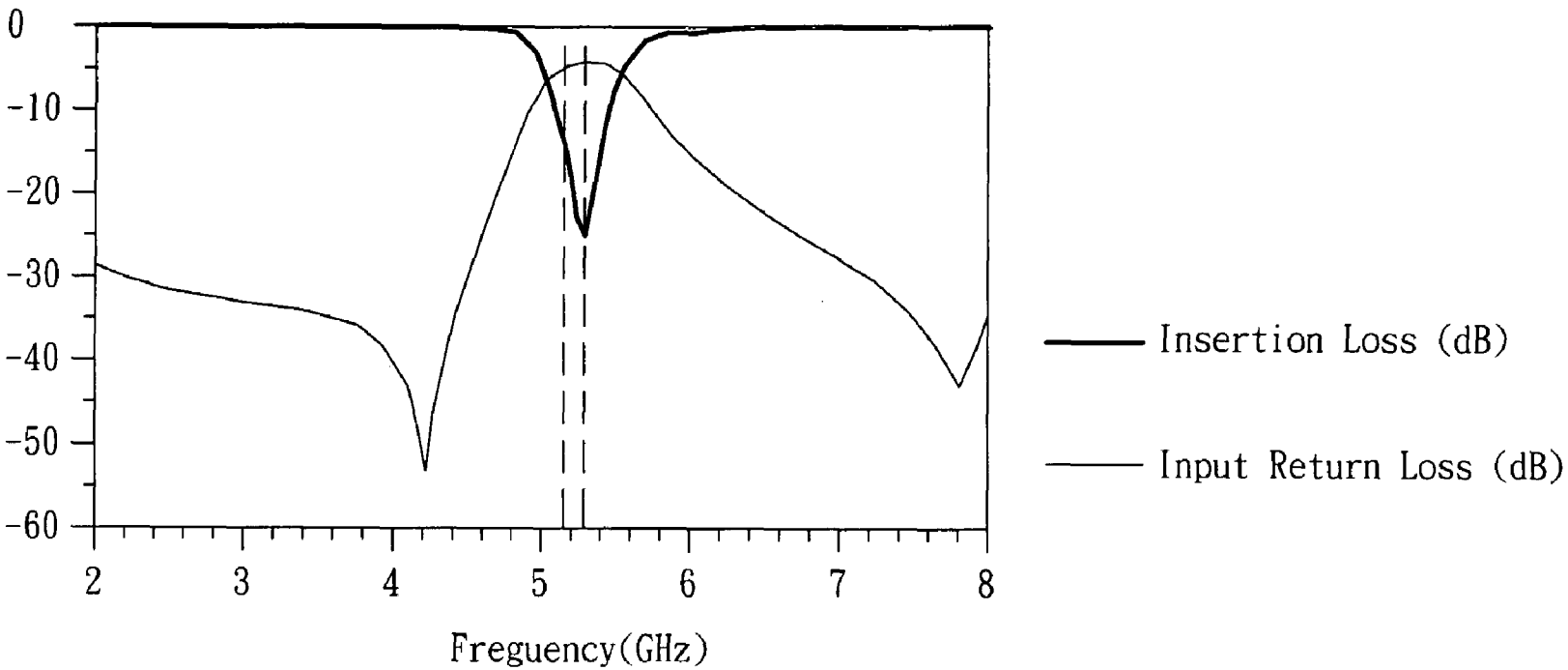
FIG. 4 shows both insertion loss and return loss of a balanced-to-unbalanced transformer embedded with a filter according to the present invention.
Figure 5A:
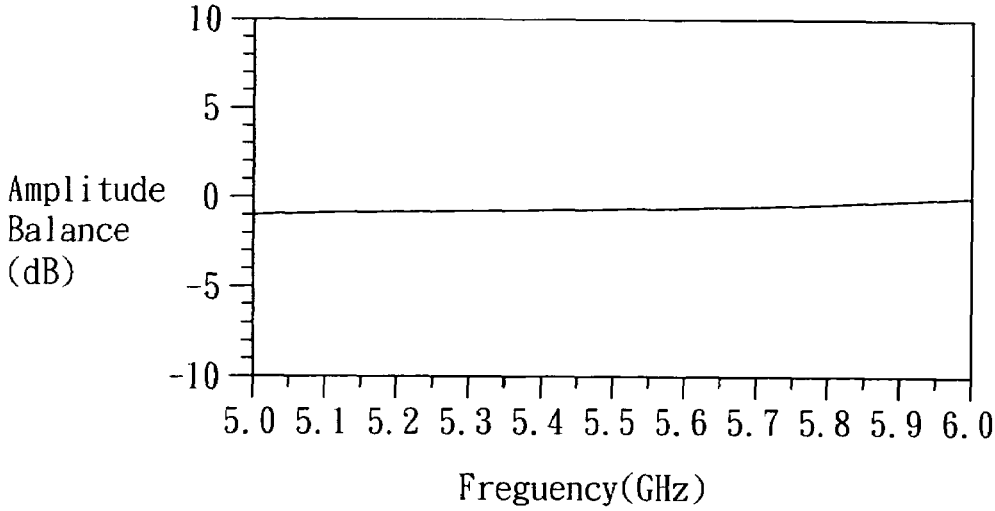
FIG. 5A shows the amplitude of a balanced-to-unbalanced transformer embedded with a filter according to the present invention.
Figure 5B:
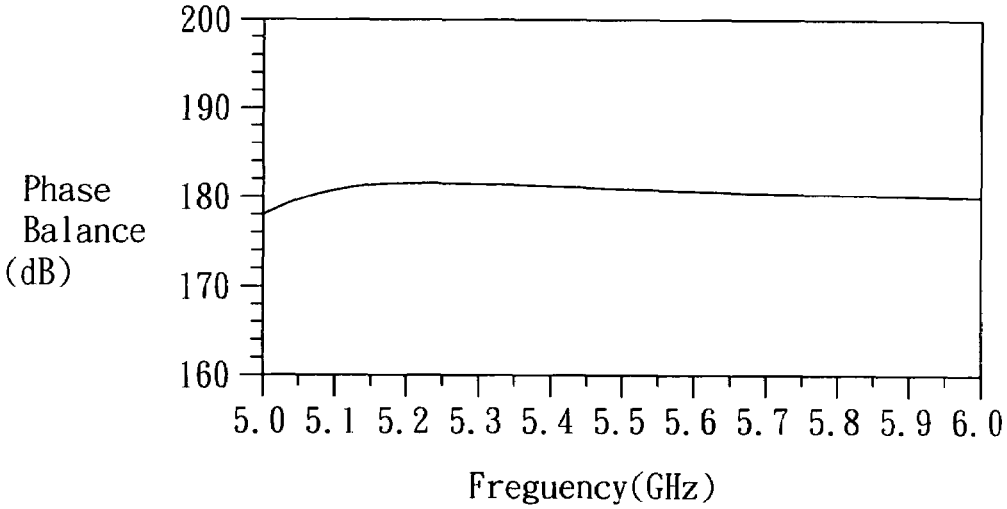
FIG. 5B shows the phase of a balanced-to-unbalanced transformer embedded with a filter according to the present invention.

FIG. 4 shows both insertion loss and return loss of a balanced-to-unbalanced transformer embedded with a filter according to the present invention. In FIG. 4, the filter of the present invention operates at about 5.25 GHz. Furthermore, FIG. 5A and FIG. 5B show the amplitude and the phase of a balanced-to-unbalanced. transformer embedded with a filter according to the present invention. FIG. 5A and FIG 5B show that the filter of the present invention performs perfectly.

Figure 6A:
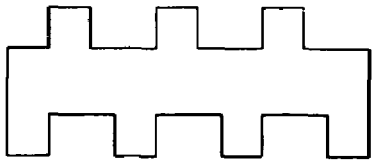
FIG. 6A shows the periodical rectangular patterns formed on the sides of broad side coupled transmission lines of a balanced-to-unbalanced transformer embedded with a filter according to the present invention.
Figure 6B:
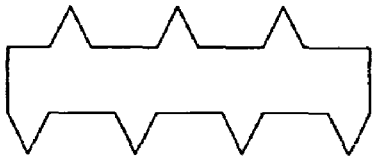
FIG. 6B shows the periodical triangular patterns formed on the sides of broad side coupled transmission lines of a balanced-to-unbalanced transformer embedded with a filter according to the present invention.
Figure 6C:
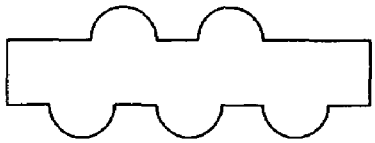
FIG. 6C shows the periodical half-circular patterns formed on the sides of broad side coupled transmission lines of a balanced-to-unbalanced transformer embedded with a filter according to the present invention.
Figure 6D:
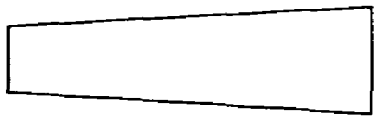
FIG. 6D shows that the width of the broad side coupled transmission lines of a balanced-to-unbalanced transformer embedded with a filter is designed to vary.

Moreover, the balanced-to-unbalanced transformer embedded with a filter according to the present invention further comprises a plurality of coplanar edge-coupled transmission lines and a plurality of non-coplanar vertically-coupled transmission lines. For example, the broad side coupled transmission lines 203*a* and 203*b* in FIG. 2 are disposed on the same layer of the substrate, while the broad side coupled transmission lines 204*a* and 204*b* are disposed on different layers of the substrate. Moreover, periodical rectangular, triangular or half-circular patterns can be formed on one or both sides of the broad side coupled transmission lines, as shown in FIG. 6A to FIG. 6C. In FIG. 6D, the width of the transmission line 205 can be designed to vary. According to the above discussion, it is apparent that the present invention discloses a balanced-to-unbalanced transformer embedded with a filter using a multi-layered substrate. In the balanced-to-unbalanced transformer, there are vertically coupled transmission lines designed in different layers in the multi-layer substrate to increase transmission performances. A capacitor and a transmission line are connected to a single-ended I/O port of the balanced-to-unbalanced transformer such that impedance matching is achieved and a band-pass filter is embedded in the balanced-to-unbalanced transformer.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A balanced-to-unbalanced transformer embedded with a filter, the balanced-to-unbalanced transformer being disposed in a multi-layered substrate and comprising:

an unbalanced single-ended I/O port, disposed in one layer of the multi-layered substrate and comprising a single-ended terminal so as to be coupled to external unbalanced elements;

a first transmission line and a second transmission line, coupled and disposed in the same layer as the unbalanced single-ended I/O port;

a balanced I/O port, disposed in another layer of the multi-layered substrate and comprising two differential transmission terminals so as to be coupled to external balanced elements;

a third transmission line and a fourth transmission line, coupled and disposed in the same layer as the balanced I/O port so as to be coupled to the two differential transmission terminals respectively, and vertically coupled to the first transmission line and the second transmission line respectively;

a fifth transmission line, disposed in the same layer as the first transmission line and the second transmission line and coupled to the first transmission line or the second transmission line; and a serial capacitor, disposed in the same layer as the fifth transmission line so as to be coupled to the fifth transmission line at one terminal and coupled to the single-ended terminal of the unbalanced single-ended I/O port at the other terminal.

2. The balanced-to-unbalanced transformer embedded with a filter as recited in claim 1, wherein the fifth transmission line and the serial capacitor formed an embedded filter so as to achieve impedance matching in the balanced-to-unbalanced transformer.

3. The balanced-to-unbalanced transformer embedded with a filter as recited in claim 2, wherein the filter and the balanced-to-unbalanced transformer are connected in the multi-layered substrate.

4. The balanced-to-unbalanced transformer embedded with a filter as recited in claim 1, wherein the multi-layered substrate is a printed-circuit board (PCB) substrate, a ceramic substrate or an IC substrate.

5. The balanced-to-unbalanced transformer embedded with a filter as recited in claim 1, wherein periodical rectangular, triangular or half-circular patterns can be formed on one or both sides of the first transmission line, the second transmission line, the third transmission line and the fourth transmission line.

6. The balanced-to-unbalanced transformer embedded with a filter as recited in claim 1, wherein the width of the fifth third transmission line varies.

7. A balanced-to-unbalanced transformer embedded with a filter, the balanced-to-unbalanced transformer being disposed in a multi-layered substrate and comprising:

an unbalanced single-ended I/O port, disposed in one layer of the multi-layered substrate and comprising a single-ended terminal so as to be coupled to external unbalanced elements;

a first transmission line and a second transmission line, coupled and disposed in the same layer as the unbalanced single-ended I/O port;

a balanced I/O port, disposed in another layer of the multi-layered substrate and comprising two differential transmission terminals so as to be coupled to external balanced elements;

a third transmission line, disposed in the same layer as the unbalanced I/O port so as to be edge-coupled to the first transmission line or the second transmission line in the same layer;

a fourth transmission line, disposed in the same layer as the balanced I/O port so as to vertically coupled to the first transmission line or the second transmission line that is not coupled to the third transmission line;

a fifth transmission line, ,disposed in the same, layer as the first transmission line and the second transmission line and coupled to the first transmission line or the second transmission line; and a serial capacitor, disposed in the same layer as the fifth transmission line so as to be coupled to the fifth transmission line at one terminal and coupled to the single-ended terminal of the unbalanced single-ended I/O port at the other terminal.

8. The balanced-to-unbalanced transformer embedded with a filter as recited in claim 7, wherein the fifth transmission line and the serial capacitor formed an embedded filter so as to achieve impedance matching in the balanced-to-unbalanced transformer.

9. The balanced-to-unbalanced transformer embedded with a filter as recited in claim 8, wherein the filter and the balanced-to-unbalanced transformer are connected in the multi-layered substrate.

10. The balanced-to-unbalanced transformer embedded with a filter as recited in claim 7, wherein the multi-layered substrate is a printed-circuit board (PCB) substrate, a ceramic substrate or an IC substrate.

11. The balanced-to-unbalanced transformer embedded with a filter as recited in claim 7, wherein periodical rectangular, triangular or half-circular patterns can be formed on one or both sides of the first transmission line, the second transmission line, the third transmission line and the fourth transmission line.

12. The balanced-to-unbalanced transformer embedded with a filter as recited in claim 7, wherein the width of the fifth third transmission line varies.

* * * * *